US008080743B2

(12) United States Patent
Wang et al.

(10) Patent No.: US 8,080,743 B2
(45) Date of Patent: Dec. 20, 2011

(54) NAVIGATION KEY OF ELECTRONIC DEVICE

(75) Inventors: He-Li Wang, Shenzhen (CN); Hong Li, Shenzhen (CN); Ting Zhang, Shenzhen (CN); Ting-Ting Zhao, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 496 days.

(21) Appl. No.: 12/239,824

(22) Filed: Sep. 29, 2008

(65) Prior Publication Data

US 2009/0107826 A1 Apr. 30, 2009

(30) Foreign Application Priority Data

Oct. 25, 2007 (CN) ..... 2007 1 0202274

(51) Int. Cl.
*H01H 13/74* (2006.01)

(52) U.S. Cl. ..... 200/5 E

(58) Field of Classification Search ..... 200/5 E, 200/5 R

See application file for complete search history.

(56) References Cited

U.S. PATENT DOCUMENTS

| | | | | |
|---|---|---|---|---|
| 6,501,036 | B2 * | 12/2002 | Rochon et al. | 200/302.2 |
| 6,844,511 | B1 * | 1/2005 | Hsu et al. | 200/6 A |
| 6,933,927 | B2 | 8/2005 | Lu | |
| 7,053,885 | B2 * | 5/2006 | Seya | 345/172 |
| 7,745,742 | B2 * | 6/2010 | Li et al. | 200/5 R |
| 2007/0099482 | A1 | 5/2007 | Yin et al. | |
| 2007/0263014 | A1 | 11/2007 | Ketola et al. | |

FOREIGN PATENT DOCUMENTS

| | | | |
|---|---|---|---|
| CN | 2638219 | Y | 9/2004 |
| JP | 11-353972 | A | 12/1999 |
| JP | 2004-119238 | A | 4/2004 |

* cited by examiner

*Primary Examiner* — Vanessa Girardi
(74) *Attorney, Agent, or Firm* — Altis Law Group, Inc.

(57) ABSTRACT

An electronic device includes a circuit board and a navigation key arranged on the circuit board. The circuit board forms a number of switches thereon. The navigation key includes a key cap, a frame, and a number of elastic connecting arms The key cap includes an annular operating portion configured for pressing, and a number of actuators extending from the operating portion towards the circuit board. Each actuator hangs above one corresponding switch, and contacts with the corresponding switch when the operation portion of the navigation key is pressed. The frame is arranged around the key cap, and is fixedly assembled to the circuit board. The elastic connecting arms interconnect the operation portion of the key cap and the frame to limit rotation of the key cap.

13 Claims, 4 Drawing Sheets

NAVIGATION KEY OF ELECTRONIC DEVICE

BACKGROUND

1. Field of the Disclosure

The disclosure relates to an electronic device, and more particularly relates to a navigation key of the electronic device.

2. Description of Related Art

Due to the continuous development of electronic techniques and rapid developments of digital technologies, portable electronic devices, such as mobile phones and personal digital assistants (PDAs), have become indispensable outfits and helpful working tools for many people.

For a mobile phone to be competitive, it must be both light weight and compact. To meet these requirements, a navigation key is thus designed to achieve multi-functions of the mobile phone, and thus to reduce a space occupied by the keypad. A conventional navigation key usually includes a circular-shaped key cap, and a number of actuating points corresponding to a number of touch switches of a circuit board. Different portion of the key cap is pressed to make different actuating point in contact with the corresponding touch switch of the circuit board. The phone then process programs according to the commands input from the different portions of the navigation key. However, as the key cap is circular, the key cap usually rotates in use, and thus the actuating point may not contact with the corresponding touch switch. The phone thus can not process programs according to the user's commands.

For the foregoing reasons, therefore, there is a need in the art for electronic device having a new navigation key which overcomes the above-mentioned problems.

SUMMARY

According to an exemplary embodiment, an electronic device includes a circuit board and a navigation key arranged on the circuit board. The circuit board forms a number of switches thereon. The navigation key includes a key cap, a frame, and a number of elastic connecting arms The key cap includes an annular operating portion configured for pressing, and a number of actuators extending from the operating portion towards the circuit board. Each actuator hangs above one corresponding switch, and contacts with the corresponding switch when the operation portion of the navigation key is pressed. The frame is arranged around the key cap, and is fixedly assembled to the circuit board. The elastic connecting arms interconnect the operation portion of the key cap and the frame to limit rotation of the key cap.

Other advantages and novel features of the disclosure will be drawn from the following detailed description of the exemplary embodiments of the disclosure with attached drawings.

DETAILED DESCRIPTION OF THE EMBODIMENTS

Figure 1:
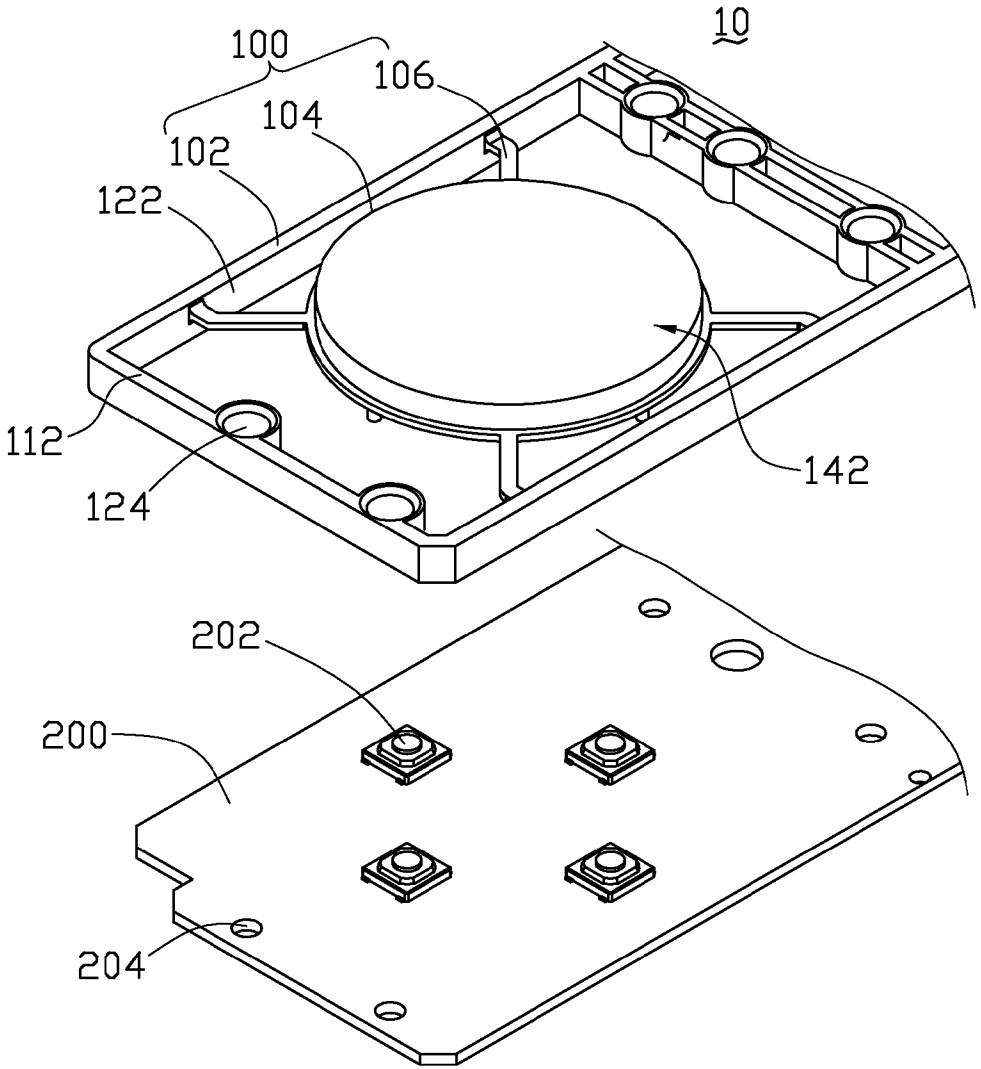
FIG. 1 is an exploded view of an electronic device having a navigation key and a circuit board.
Figure 2:
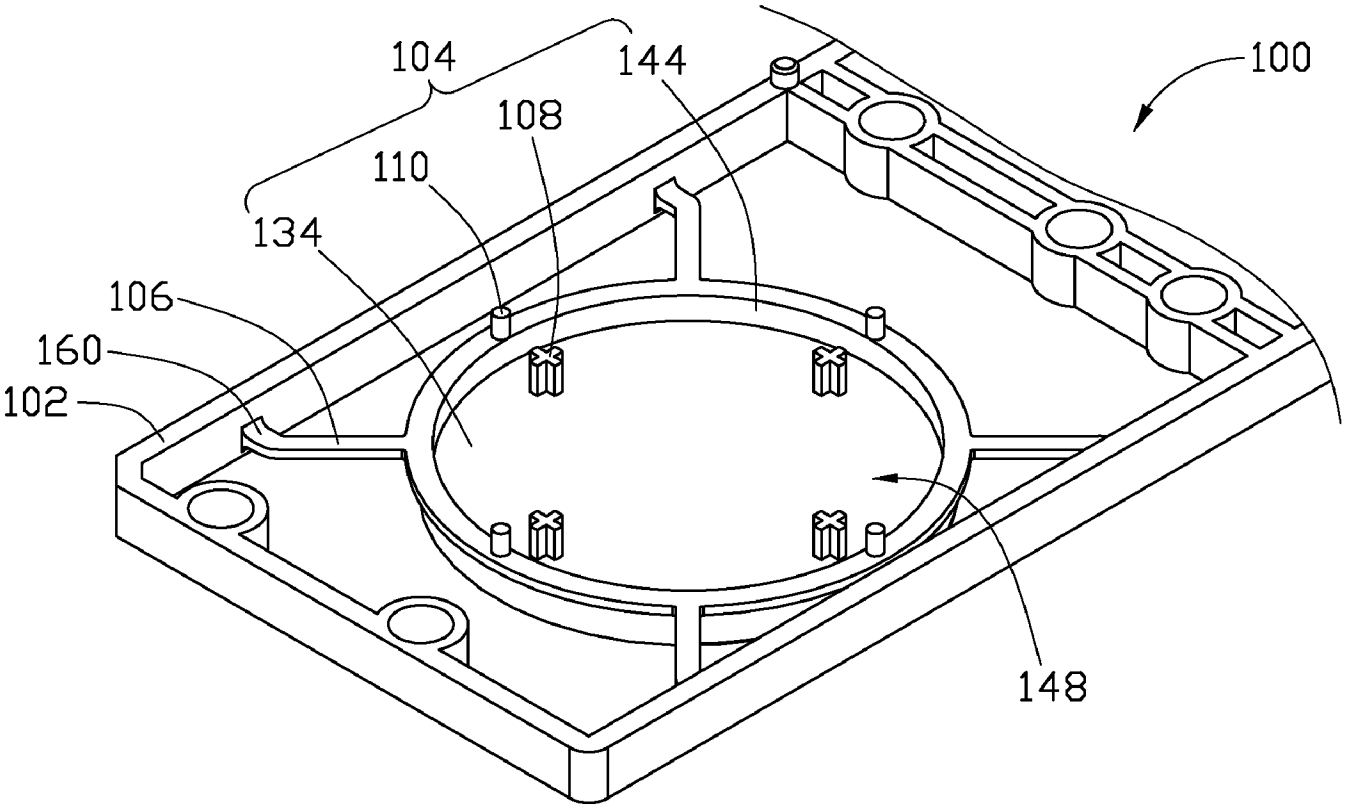
FIG. 2 shows the navigation key of FIG. 1 viewed from a bottom aspect.

Referring to FIGS. 1 and 2, an electronic device 10 according to an exemplary embodiment includes a circuit board 200, and a navigation key 100 arranged on the circuit board 200. For clearly shown the navigation key 100, other components of the electronic device 10 are omitted.

The navigation key 100 includes a frame 102, a key cap 104, and four elastic connecting arms 106. The frame 102 is rectangular and hollow, and includes two opposite shorter sides 112 and two opposite longer sides 122. A number of mounting holes 124 are defined in the shorter sides 112 of the frame 102. The circuit board 200 defines a number of locking holes 204 corresponding to the mounting holes 124 of the frame 102. When the navigation key 100 is assembled to the circuit board 200, locking devices, such as screws and rivets, extend through the mounting holes 124 and the locking holes 204 to assemble the navigation key 100 and the circuit board 200 together. Alternatively, the mounting holes 124 can be defined in the longer sides 122 of the frame 102 or in all of the sides 112, 122 of the frame 102.

The key cap 104 is arranged in a center of the frame 102. The key cap 104 includes an operating portion 134, a flange 144, four actuators 108, and four restricting legs 110. The operating portion 134 is circular shaped, and includes an operating surface 142 formed at a top side of the key cap 104, and a bottom surface 148 opposite to the operating surface 142. The operating surface 142 is convex. Alternatively, the operating surface 142 of the operating portion 134 of the key cap 104 can be concave or flat. The operating surface 142 is a little higher than the frame 102, and thus when the navigation key 100 is assembled to the electronic device 10, the operating surface 142 of the navigation key 100 is a little higher than an outer surface of the electronic device 10 which is convenient for operating of the users.

The flange 144 is annular, and extends perpendicularly and downward from a periphery of the operating portion 134. The four actuators 108 extend substantially perpendicularly from the bottom surface 148 of the key cap 104. Each actuator 108 has a cross section being X-shaped. The four actuators 108 are located adjacent to the flange 144. The four actuators 108 are symmetrical about a center of the key cap 104, and surrounding the center of the key cap 104 at regular intervals. Thus, the press surface 142 of the key cap 104 are divided into four quadrants, each quadrant correspond to one actuator 108. The four restricting legs 110 extend downwardly from a bottom of the flange 144. The four restricting legs 110 are columnar. The four restricting legs 110 are configured for protecting the actuators 108. Each restricting leg 110 is longer than the actuator 108. The restricting legs 110 and the actuators 108 are aligned along a pair of orthogonal axes that intersects at the center of the key cap 104 correspondingly.

The four elastic connecting arms 106 extend radially and outwardly from the flange 144 to the frame 102. The four elastic connecting arms 106 extend at regular intervals from the flange 144. The elastic connecting arms 106 and the actuators 108 are arranged in an alternating manner around the center of the key cap 104. A distal end 160 of each of the elastic connecting arms 106 bends to the frame 102 and is substantially perpendicularly to the frame 102. In this embodiment, the four distal ends 160 are connected to the longer sides 122 of the frame 102 correspondingly, a pair distal ends 160 connected to one longer side 122, and the other two distal ends 160 connected to the opposite longer side 122 of the frame 102.

Figure 3:
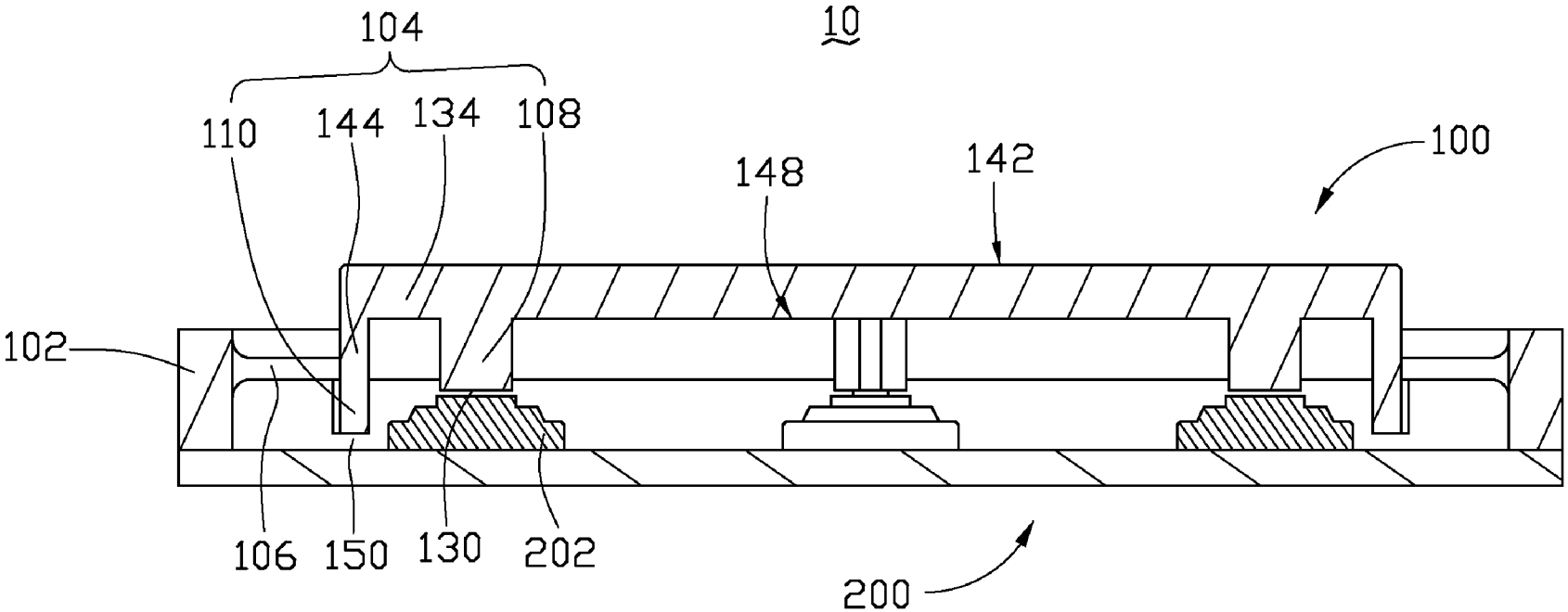
FIG. 3 shows an assembled, cross-sectional view of FIG. 1.
Figure 4:
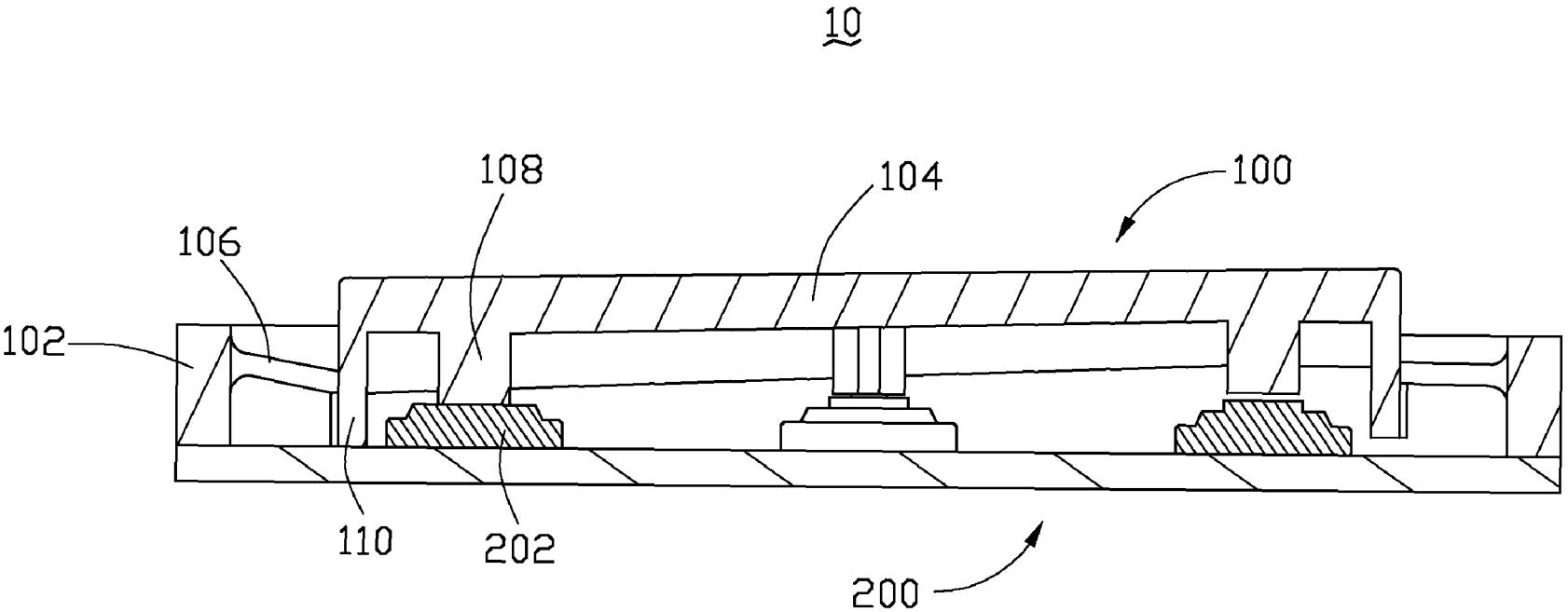
FIG. 4 shows the navigation key in a usage state.

FIG. 3 shows the navigation key 100 assembled to the circuit board 200 and not being pressed. In this situation, all of the elastic connecting arms 106 are at a normal state. The circuit board 200 forms four switches 202 corresponding to the four actuators 108. Each actuator 108 hangs over one corresponding switches 202, and a clearance 130 is defined between the actuator 108 and the corresponding switches 202. The restricting legs 110 hang over the circuit board 200, and a gap 150 is defined between each restricting leg 110 and the circuit board 200. A depth of the gap 150 along a longitudinal direction is a little greater than that of the clearance 130. FIG. 4 shows a usage state of the electronic device 10, i.e., one of the four quadrants of the navigation key 100 is pressed. In this situation, one of the elastic connecting arms 106 corresponding to the pressed quadrant of the navigation key 100 is deformed. The actuator 108 corresponding to the pressed quadrant moves toward and comes in contact with the corresponding switches 202 of the circuit board 200. The electronic device 10 thus can process programs according to the input commands.

As the actuator 108 moves downward, the restricting leg 110 near the moving actuator 108 also moves toward the circuit board 200. Since the gap 150 is greater than the clearance 130, the restricting leg 110 near the moving actuator 108 is spaced from the circuit board 200 before the actuator 108 contacts with the switches 202. However, after the actuator 108 contacts with the switches 202, if the key cap 104 is pressed with an excessive force, the restricting leg 110 moves downward and abuts against the circuit board 200 to limit further movement of the key cap 104. Thus the restricting legs 110 can protect the navigation key 100 from damages. In addition, the key cap 104 of the navigation key 100 are connected to the frame 102 by the elastic connecting arms 106, thus the key cap 104 can not rotate during operation of the electronic device 10. Each actuator 108 and the corresponding switches 202 are collinear along the longitudinal direction. When the navigation key 100 is pressed, the actuators 108 can touch to the switches 202 accurately. Thus operation of the electronic device 10 is convenient, and the electronic device 10 is more popular to the users.

It is to be understood, however, that even though numerous characteristics and advantages of the disclosure have been set forth in the foregoing description, together with details of the structure and function of the disclosure, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. An electronic device, comprising:

a circuit board forming a number of switches thereon; and a navigation key arranged on the circuit board, the navigation key comprising:

a key cap having an annular operating portion being configured for pressing;

a number of actuators extending from the operating portion of the key cap towards the circuit board, each actuator hanging above one corresponding switch and being configured for contacting with the corresponding switch when the operation portion of the navigation key is pressed;

a frame arranged around the key cap, the frame being fixedly assembled to the circuit board, wherein the frame is rectangular and hollow, a number of mounting holes being defined in the frame for securing the frame with the circuit board; and a number of elastic connecting arms, interconnecting the operation portion of the key cap and the frame to limit rotation of the key cap.

2. The electronic device of claim 1, wherein each elastic connecting arm extends along a radial direction of the operation portion of the key cap, and a distal end of the connecting arm connected to the frame is perpendicular to the frame.

3. The electronic device of claim 1, wherein the actuators and the elastic connecting arms are arranged in an alternating manner around a center of the key cap and are evenly spaced from each other.

4. The electronic device of claim 1, wherein the elastic connecting arms are connected with two opposite longer sides of the frame.

5. The electronic device of claim 1, further comprising a number of restricting legs extending from the key cap, each restricting leg located near one of the actuators, a distance between the circuit board and a bottom of each restricting leg being large than a distance between each switch and a bottom of the corresponding actuator.

6. The electronic device of claim 5, wherein the bottom of the restricting leg is lower than the bottom of the actuator.

7. The electronic device of claim 5, wherein the navigation key comprises four actuators and four elastic connecting arms, each restricting leg and the corresponding actuator being aligned along a pair of orthogonal axes that intersects at the center of the key cap.

8. An electronic device, comprising:

a circuit board forming a number of switches thereon; and a key cap having an annular operating portion being configured for pressing, a number of actuators and a number of restricting legs extending from the operation portion towards the circuit board, the actuators and the restricting legs being spaced from the circuit board, each actuator being configured for contacting with one corresponding switches when the operation portion of the key cap is pressed, wherein when one of the actuators contacts with the corresponding switch, one nearest restricting legs collides with the circuit board;

a frame arranged around the key cap, the frame being fixedly assembled to the circuit board, wherein the frame is rectangular and hollow, a number of mounting holes being defined in the frame for securing the frame with the circuit board; and a plurality of elastic support arms, wherein opposite ends of each elastic connecting arm are respectively connected to the operation portion of the key pad and the frame to limit rotate of the key pad.

9. The electronic device of claim 8, wherein each elastic connecting arm extends along a radial direction of the operation portion of the key cap, and a distal end of the connecting arm connected to the frame is perpendicular to the frame.

10. The electronic device of claim 8, wherein the actuators and the elastic connecting arms are arranged in an alternating manner around a center of the key cap and are evenly spaced from each other.

11. The electronic device of claim 8, wherein the elastic connecting arms are connected with two opposite longer sides of the frame.

12. The electronic device of claim 8, further comprising a number of restricting legs extending from the key cap, each restricting leg located near one of the actuators, a bottom of the restricting leg is lower than a bottom of the actuator, a distance between the circuit board and the bottom of each restricting leg being larger than a distance between each switch and the bottom of the corresponding actuator.

13. The electronic device of claim 12, wherein the navigation key comprises four actuators and four elastic connecting arms, each restricting leg and the corresponding actuator being aligned along a pair of orthogonal axes that intersects at the center of the key cap.

* * * * *